US006575314B2

(12) United States Patent
Lung et al.

(10) Patent No.: US 6,575,314 B2
(45) Date of Patent: Jun. 10, 2003

(54) APPARATUS AND METHOD FOR DISPLAYING GOODS

(75) Inventors: Laura R. Lung, Irvine, CA (US); Louise M. Grimm, Newport Beach, CA (US)

(73) Assignee: Bob Siemon Designs, Inc., Santa Ana, CA (US)

( * ) Notice: Subject to any disclaimer, the term of this patent is extended or adjusted under 35 U.S.C. 154(b) by 26 days.

(21) Appl. No.: 09/896,948

(22) Filed: Jun. 29, 2001

(65) Prior Publication Data

US 2003/0000904 A1 Jan. 2, 2003

(51) Int. Cl.[7] ..... A47F 5/00
(52) U.S. Cl. ..... 211/163; 211/205; 211/59.1
(58) Field of Search ..... 211/163, 205, 211/95, 59.1, 57.1, 169

(56) References Cited

U.S. PATENT DOCUMENTS 982,216 A * 1/1911 Madden et al.
1,718,881 A * 6/1929 Schander
3,756,422 A * 9/1973 Ostring et al. ..... 211/163
3,891,092 A * 6/1975 Surrette et al. ..... 211/163 X
4,211,331 A * 7/1980 Salmon et al. ..... 211/163 X
4,296,866 A * 10/1981 Learnard ..... 211/163 X
4,815,612 A * 3/1989 Leo ..... 211/189
5,096,073 A * 3/1992 O'Brien ..... 211/163
5,586,664 A * 12/1996 Taylor ..... 211/163 X
5,595,309 A * 1/1997 Bauer et al. ..... 211/59.1
5,606,815 A * 3/1997 Feldwhere
5,927,517 A * 7/1999 Lipman et al. ..... 211/59.1

* cited by examiner

*Primary Examiner*—Robert W. Gibson, Jr.
(74) *Attorney, Agent, or Firm*—Myers Dawes & Andras LLP; Vic Y. Lin; Joseph C. Andras

(57) ABSTRACT

A kiosk includes multiple poles with a plurality of independently rotatable components disposed on each pole. Each component comprises a hollow supporting body made rotatable by way of bushings disposed on the top and bottom of the body and bearings disposed adjacent to each bushing. The component further includes a pair of slat boards removably coupled to the supporting body. Even though each slat board may have a different configuration of protrusions extending from the front surface for holding goods, clips on the back surface of each board are similarly configured to enable any board to be removably coupled to a supporting body. Related methods are also disclosed.

24 Claims, 5 Drawing Sheets

80
82
88
84
86
85
30
28
22
32
85
84
28
86
88
22
84
85
60
28

APPARATUS AND METHOD FOR DISPLAYING GOODS

BACKGROUND OF THE INVENTION

1. Field of the Invention

The invention relates generally to display stands for goods.

2. Description of Prior Art and Related Information

Display stands are commonly found in areas where consumers are likely to browse products. Conventional rotating kiosks include at least one pole to which means for carrying goods are attached. For instance, a typical greeting card kiosk may include several levels of carriers, such as trays, stacked on a pole. One of the problems with conventional rotating kiosks, however, is that the levels of carriers stacked on the pole are rigidly fixed to one another such that rotating any one of the levels on the pole causes all the other levels to rotate as well. In effect, this allows only one person to view the products on a particular kiosk since carriers on a particular level cannot be rotated without disturbing the carriers on a different level.

In the retail arena where access to products is key to enhancing sales, a retailer might be left with the sole option of purchasing more kiosks. Such a solution, however, may be impractical for a variety of reasons. First, a store may not have sufficient goods to be placed on a plurality of kiosks. Secondly, the cost of kiosks may also prevent a retailer from acquiring more. Even with kiosks that have multiple poles, consumers are still unable to simultaneously view products on the same stack or pole.

Furthermore, retailers are constantly changing the goods being offered in the store. Conventional kiosks, however, provide little flexibility in displaying different types of goods. Not only do conventional display stands lack the capacity to accommodate different types of goods, such conventional stands also lack the flexibility in changing the manner in which the goods are displayed on the stand. In competitive industries where drawing the consumer's attention is vital, such limitations can greatly hinder the sales and success of a business.

SUMMARY OF THE INVENTION

In one aspect, a display apparatus comprises a pole and a plurality of independently rotatable components stacked on the pole. Each component comprises at least one slat board. The slat board has a substantially vertical display surface and at least one projection extending from the display surface. The component further comprises a supporting body, with the slat board being removably coupled to the supporting body. The slat board comprises a clip. The supporting body comprises an aperture for receiving the clip. The supporting body comprises a rectangular box. The apparatus further comprises a base and a cap. Each component is rotatably coupled to the pole with an upper bushing and a lower bushing. The apparatus may comprise a plurality of poles with a plurality of independently rotatable components stacked on each pole.

In another aspect, an apparatus for displaying goods comprises a supporting body and slat board. The supporting body comprises a first supporting surface, a first aperture defined in the first supporting surface, a second supporting surface spaced apart from the first supporting surface, a second aperture defined in the second supporting surface, a top opening, and a bottom opening. The slat board comprises a front surface, a substantially parallel back surface opposite to the front surface, a protrusion extending from the front surface for supporting the wares, and a clip coupled to the back surface. The slat board is removably coupled to the supporting body with the clip being received in the first or second aperture of the supporting body. The back surface of the slat board is disposed against the first supporting surface or the second supporting surface of the supporting body. The supporting body comprises a hollow cavity. The apparatus may further comprise a pole that is disposed through the supporting body. The apparatus may further comprise a second slat board in which case the first clip of the first slat board is received in the first aperture of the supporting body and a second clip of the second slat board is received in the second aperture of the supporting body. The apparatus may further comprise an extension removably coupled to a bottom of the supporting body. The supporting body may have opaque side surfaces.

A method for assembling a display apparatus is provided. The method comprises: disposing a first independently rotatable supporting body on a pole; disposing a second independently rotatable supporting body on the pole; removably coupling a first slat board to the first supporting body; and removably coupling a second slat board to the second supporting body. Removably coupling a first slat board to the first supporting body comprises inserting a clip of the first slat board into an aperture of the first supporting body. The method further comprises coupling each supporting body to the pole with bushings. The method further comprises providing a second pole and disposing a third independently rotatable supporting body and a fourth independently rotatable supporting body on the second pole.

A method for manufacturing a display apparatus is provided. The method comprises: providing a supporting body having a supporting surface; forming an aperture in the supporting surface; providing a slat board with a front surface and a back surface; providing a configuration of protrusions extending from the front surface of the slat board; coupling a clip to the back surface of the slat board; configuring the clip of the slat board to be removably inserted into the aperture of the supporting body. The method further includes coupling additional slat boards to the supporting body. More specifically, the method further comprises: providing a second slat board with a second clip; configuring the second clip of the second slat board to be removably inserted into the aperture of the supporting body; and providing a second configuration of protrusions extending from a front surface of the second slat board that is different from the first configuration of protrusions. Forming an aperture in the supporting surface comprises forming a first aperture in a first supporting surface of the supporting body. The method further comprises: forming the supporting body with a second supporting surface; and forming an aperture in the second supporting surface. Providing a slat board with a front surface and a back surface comprises providing a first slat board with a first clip. The method further comprising providing a second slat board with a second clip configured to be removably inserted into the second aperture of the supporting body.

A method for displaying goods is also provided. The method comprises: providing a plurality of independently rotatable bodies stacked on a pole; removably coupling a first slat board to a first side of each body and a second slat board to an opposite second side of each body; and hanging goods on protrusions extending from each slat board. The method of claim E1 further comprises: removing one of the slat boards from its corresponding body, the removed slat board having a first configuration of protrusions; and removably coupling a different slat board to the corresponding body, the different slat board having a second configuration of protrusions different from the first configuration of protrusions.

In conclusion, a kiosk includes multiple poles with a plurality of independently rotatable components disposed on each pole. Each component comprises a hollow supporting body made rotatable by way of bushings disposed on the top and bottom of the body and bearings disposed adjacent to each bushing. The component further includes a pair of slat boards removably coupled to the supporting body. Even though each slat board may have a different configuration of protrusions extending from the front surface for holding goods, clips on the back surface of each board are similarly configured to enable any board to be removably coupled to a supporting body. Related methods are also disclosed.

The invention, now having been briefly summarized, may be better visualized by turning to the following drawings wherein like elements are referenced by like numerals.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS

Figure 1:
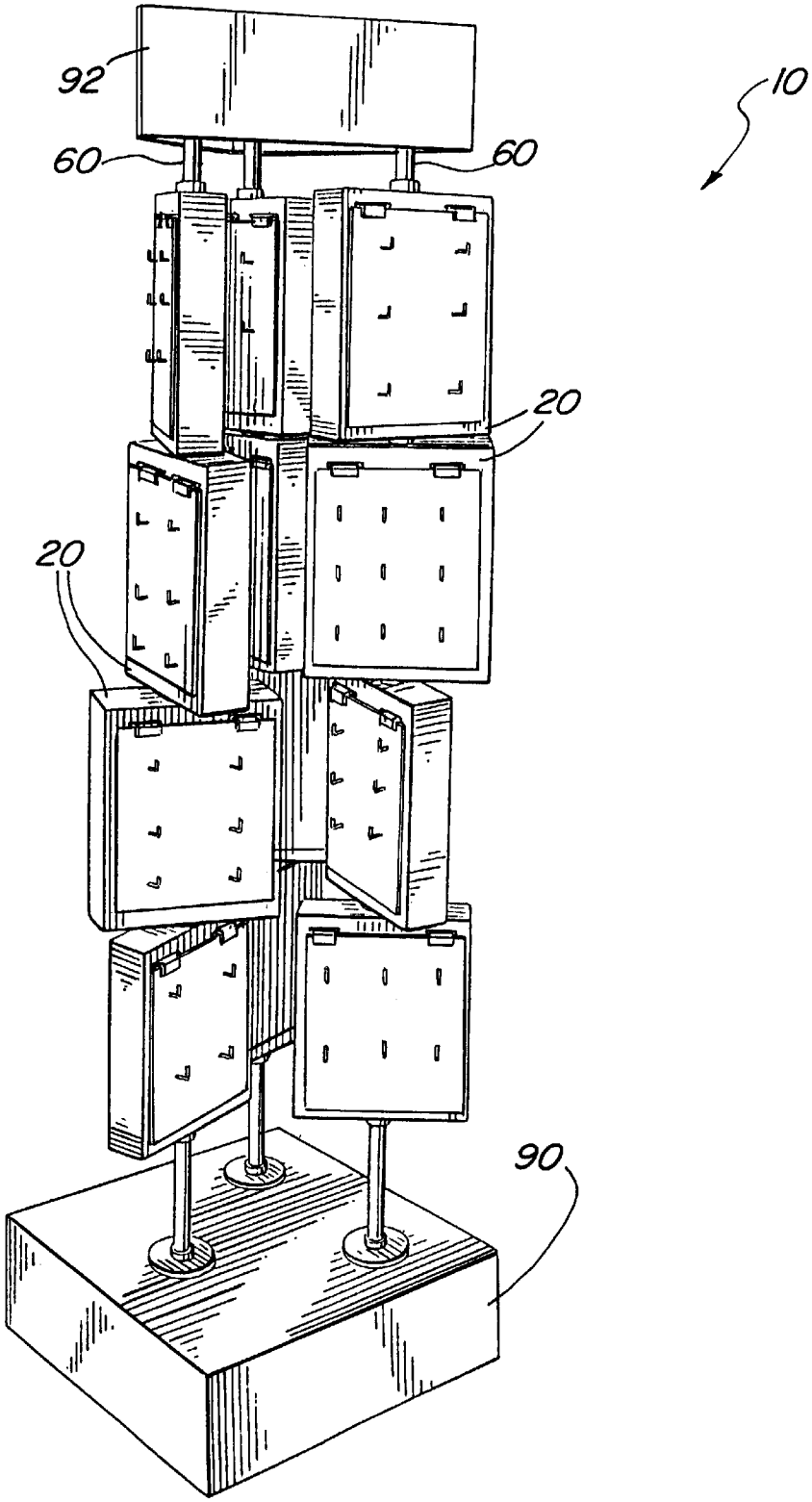
FIG. 1 is a perspective view of a display apparatus according to the invention.

FIG. 1 is a perspective view of a display apparatus, or kiosk, 10. The apparatus 10 comprises a plurality of independently rotatable components 20 disposed on each pole 60. In a preferred embodiment, as shown in FIG. 1, multiple poles 60 are provided with a plurality of components 20 stacked on each pole. The poles 60 are coupled to a base 90 and a cap 92.

Figure 2:
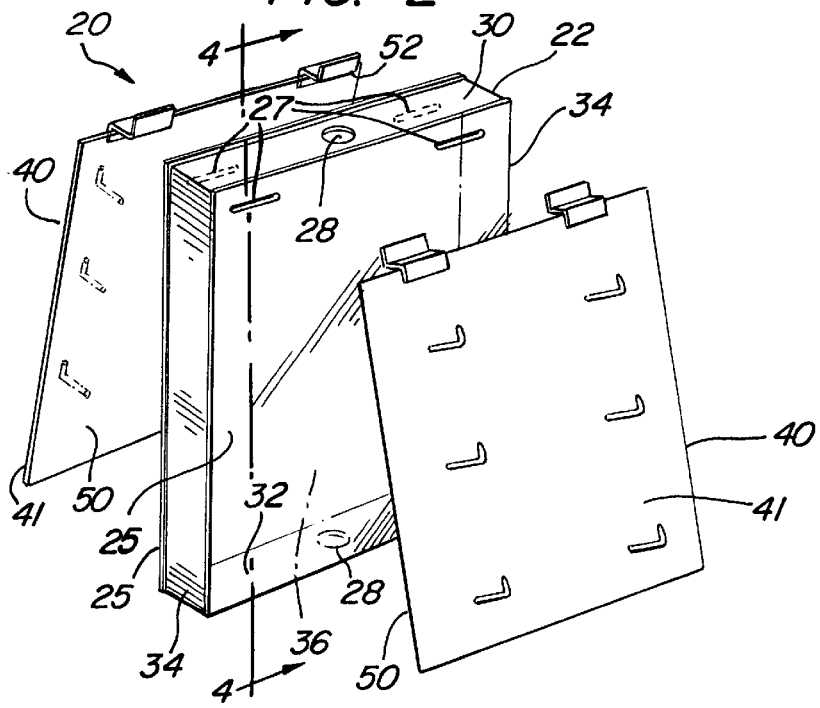
FIG. 2 is an exploded, perspective view of an independently rotatable display component.
Figure 3:
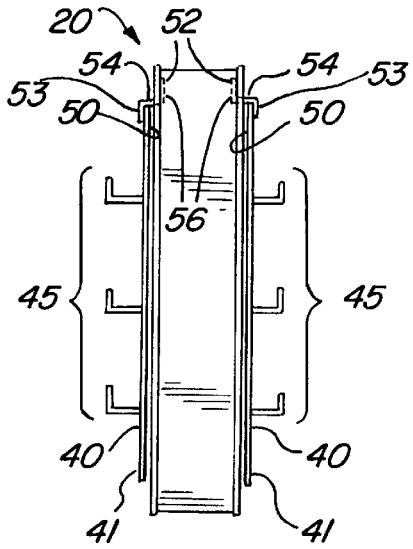
FIG. 3 is a side view of the independently rotatable display component.
Figure 4:
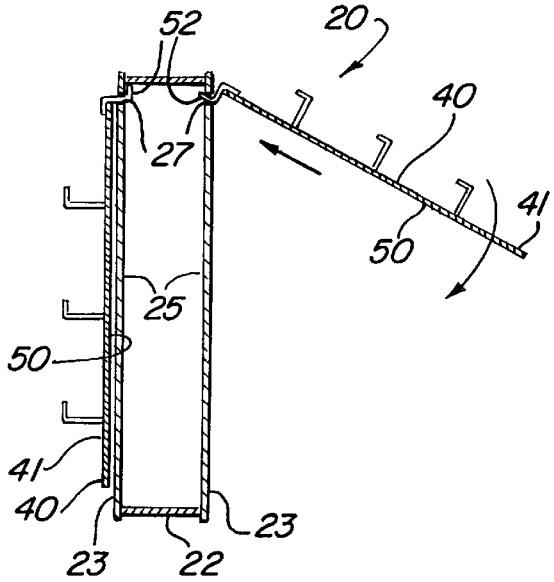
FIG. 4 is a cross-sectional side view of the independently rotatable display component.
Figure 5:
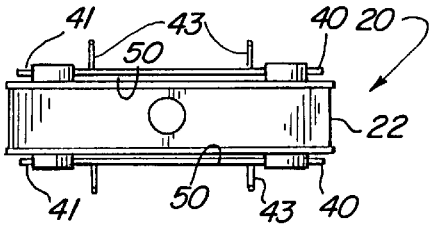
FIG. 5 is a top plan view of the independently rotatable display component.
Figure 6:
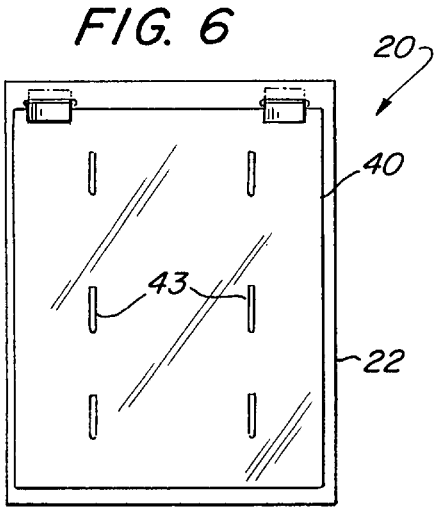
FIG. 6 is a front view of the independently rotatable display component.

In FIGS. 2–4, the independently rotatable component 20 comprises a body 22 and at least one slat board 40 removably coupled to the body 22. The body 22 comprises oppositely facing supporting surfaces 23 defined on two supporting walls 25 spaced apart from and substantially parallel to each other. Apertures 27 are formed in the supporting walls 25 and configured for receiving the slat boards 40 as described further below. Openings 28 are formed in a top wall 30 and a bottom wall 32 of the body 22 for receiving the pole 60. Side walls 34 are provided. Therefore, the body 22 comprises a three-dimensional structure with a substantially hollow cavity 36 through which the pole and rotating mechanisms are disposed. In a preferred embodiment, the body 22 is composed of a light transmitting material, such as glass or plastic, such that the supporting walls 25 are transparent while the side walls 34 are translucent.

In FIGS. 2–6, at least one slat board 40 is coupled to each body 22. In a preferred embodiment, a pair of slat boards 40 are coupled to each body 22 and disposed along the supporting walls 25 thereof. Each slat board 40 comprises a front, or display, surface 41 and a back surface 50. Projections 43 extend outwardly from the front surface 41. In a preferred embodiment, the projections 43 comprise hooks upon which packaged products may be hung. In FIG. 3, the slat board 40 may be manufactured with a particular configuration 45 of projections 43 specifically designed for holding certain products. For example, if relatively smaller objects are to be displayed, a more concentrated configuration 45 may include a greater number of projections 43 which are more closely spaced together. Alternatively, if larger objects are to be displayed, a less concentrated configuration 45 may include a lesser number of projections 43 spaced further apart from each other. Not only is the number of projections variable, but the arrangement, or pattern, of the projections 43 may vary. Thus, the configuration 45 may comprise symmetrical arrays of projections 43 or an asymmetrical arrangement.

In FIGS. 3 and 4, the slat board 40 further comprises clips 52 having a "Z" shape in the preferred embodiment. More specifically, a clip 52 comprises a first vertical arm 53 coupled to the front surface 41, a horizontal arm 54 extending from the first vertical arm 54, and a second vertical arm 56 extending perpendicularly from the horizontal arm 54. The slat boards 40 are removably coupled to the supporting bodies 22 by way of the "Z-clips" 52 being received, at least in part, in the apertures 27 of the supporting walls 25. The back surface 50 of each slat board 40 rests against the supporting surface 23 of the supporting body 22.

In one aspect, it will be appreciated that a structure is provided for incorporating slat boards 40 into a rotatable kiosk. In another aspect, it will also be appreciated that the slat boards 40 are made rotatable by way of the independently rotatable supporting bodies 22.

Figure 7:
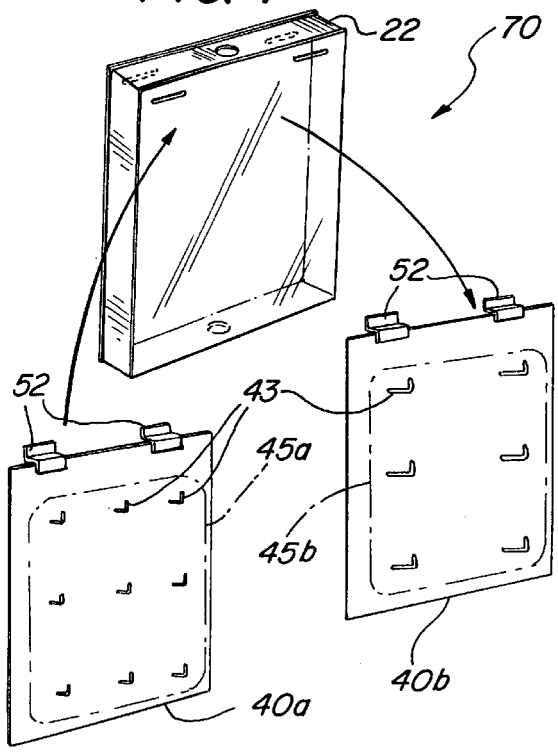
FIG. 7 is a perspective view of a display system according to the invention.

In a further aspect, it will be appreciated that a system is provided for mounting differently configured slat boards 40 onto a single rotating body 22. As discussed above, each component 20 comprises at least one slat board 40 removably coupled to a supporting body 22. In FIG. 7, the system 70 comprises the supporting body 22 and a plurality of differently configured slat boards 40*a*, 40*b*. The system 70 is made compatible by standardizing the clips 52 extending from the back surface 50 of each slat board 40*a*, 40*b* such that they correspond with the apertures 27 defined in the supporting walls 25 of the supporting body 22. Each slat board 40*a*, 40*b*, however, may have a different configuration 45*a*, 45*b*, respectively, of protrusions 43. As a merchant desires to change the products being displayed on the kiosk, the process simply comprises removing an old slat board

40*a* with an old configuration 45*b* and mounting a new slat board 40*b* with a new configuration 45*b* onto the supporting body 22. Therefore, it will be appreciated that it is unnecessary to disassemble the kiosk.

Figure 8:
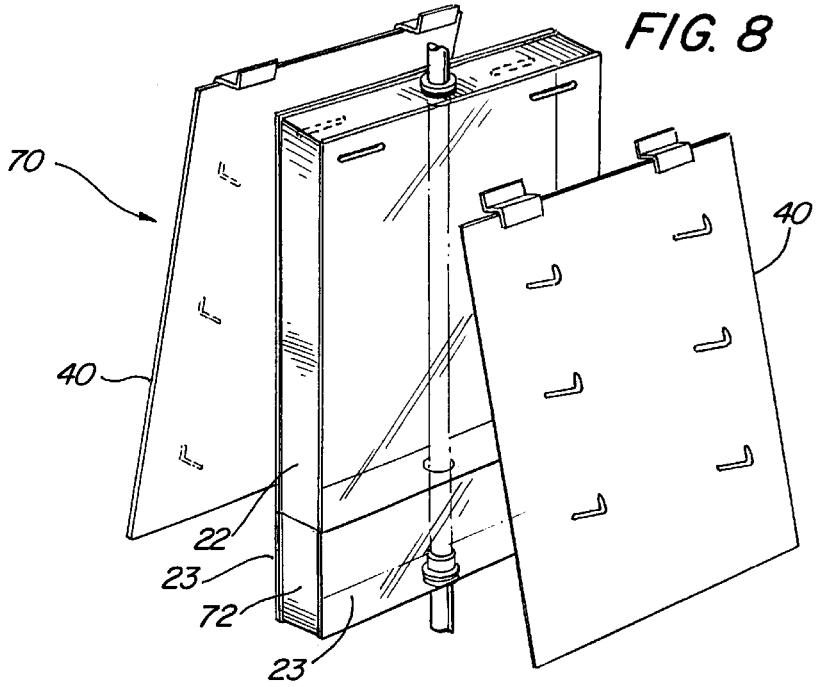
FIG. 8 is an exploded perspective view of an alternate rotatable display component with an extension member.

In FIG. 8, the system 70 further comprises an optional extension member 72 that may be disposed above or beneath a supporting body 22. The extension member 72 provides extended supporting surfaces 23 for backing extended slat boards 40. The extension member 72 is made compatible with the supporting body 22 by having the same width "W" and thickness "T" as the supporting body 22.

Figure 9:
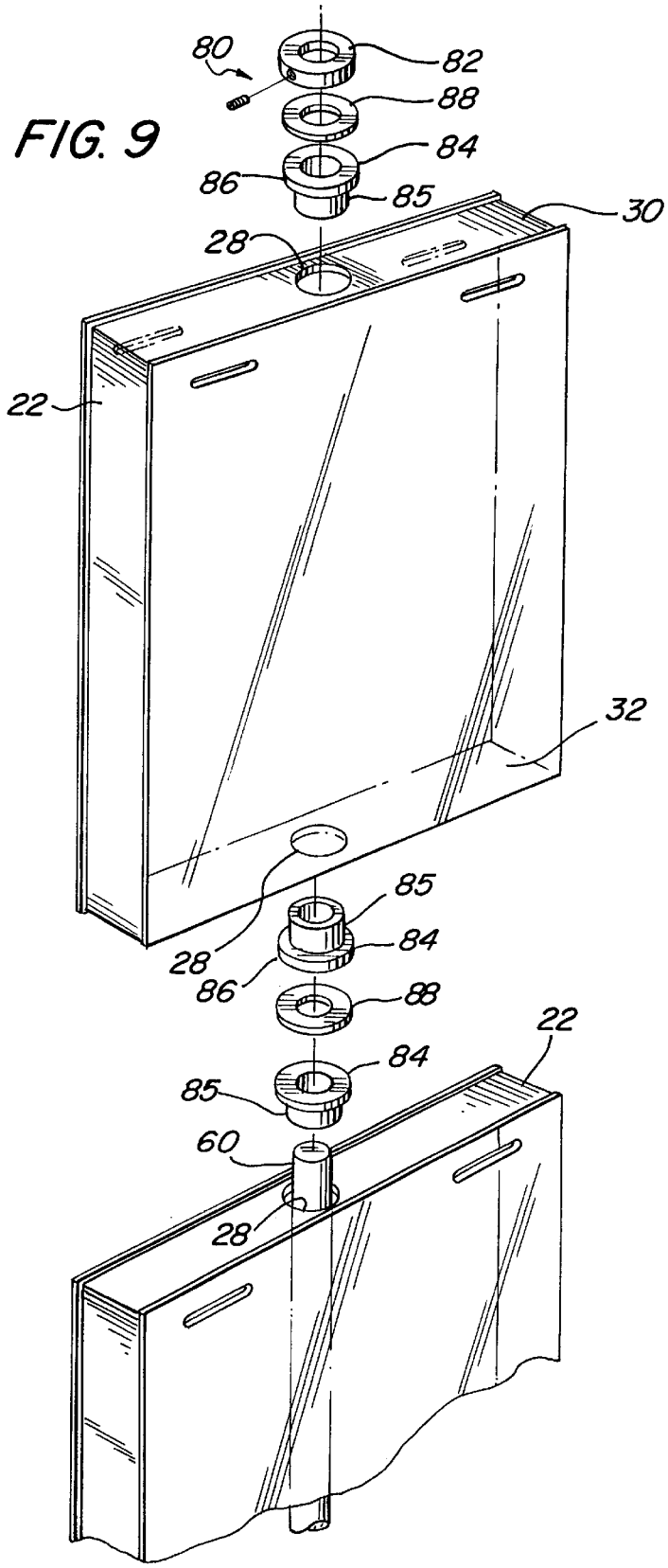
FIG. 9 is an exploded, perspective view of a partial stack of independently rotatable display components.
Figure 10:
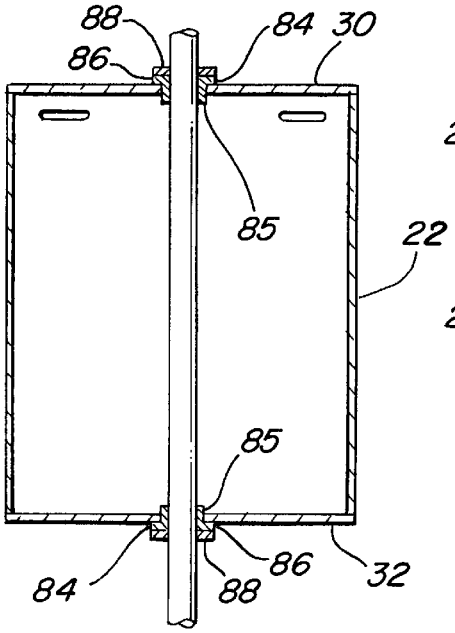
FIG. 10 is a cross-sectional view of a rotatable body disposed on a pole of the display apparatus.
Figure 11:
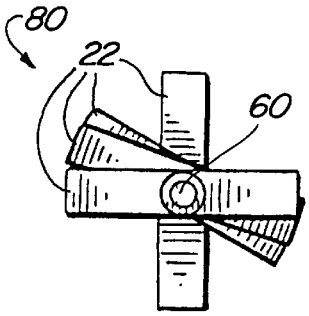
FIG. 11 is a top view of the stack of independently rotatable display components

FIG. 9 is an exploded view of a stack 80 according to the invention. Even though the stack 80 comprises the pole which would be disposed through the various elements shown in FIG. 9, the pole is drawn in hidden view lines in order to more clearly illustrate the other elements. Locks 82 are disposed at the top and bottom of the stack 80 to hold the stack 80 at a certain position along the pole. Bushings 84 are disposed at the top and bottom of each body 22. More specifically, the cylinder 85 of each bushing is inserted through the opening 28 defined in the top wall 30 and bottom wall 32 of the supporting body 22, as shown in FIG. 10. The annular flanges 86 of the bushings 84 are disposed adjacent to external surfaces of the top wall 30 and bottom wall 32. A bearing 88 is disposed between each pair of adjacent bushings 84 for enabling each supporting body 22 to rotate independently of the other supporting bodies 22 on the same pole. Bearings 88 are also provided between the locks 82 and adjacent bushings 84. It will be appreciated that the combination of the bushings 84 and bearings 88 enable each supporting body 22 to rotate smoothly without causing any other body 22 on the pole to turn. As shown in FIG. 11, this enables each supporting body 22 on a pole 60 to be disposed at a different angle.

Figure 12:
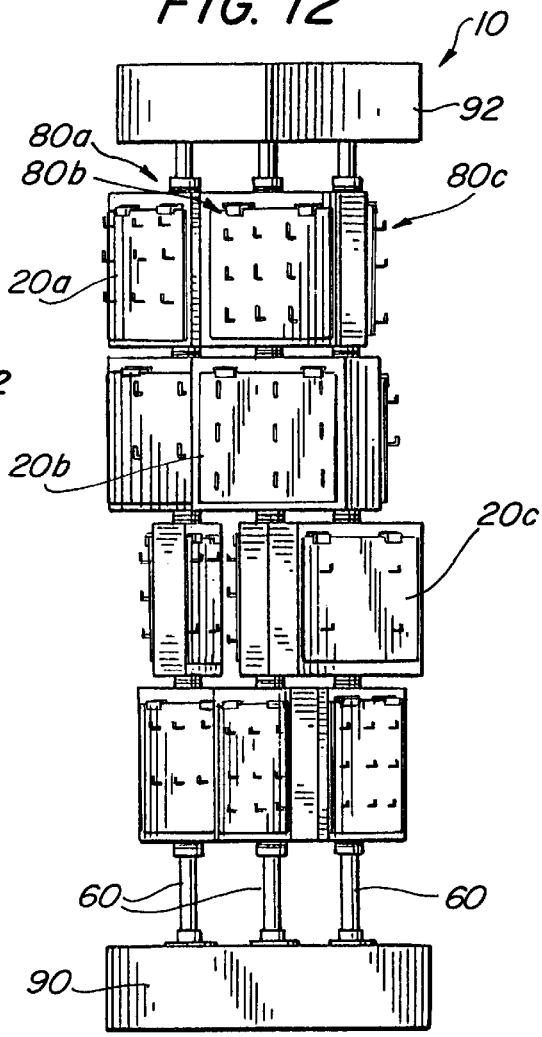
FIG. 12 is a front view of the display apparatus.
Figure 13:
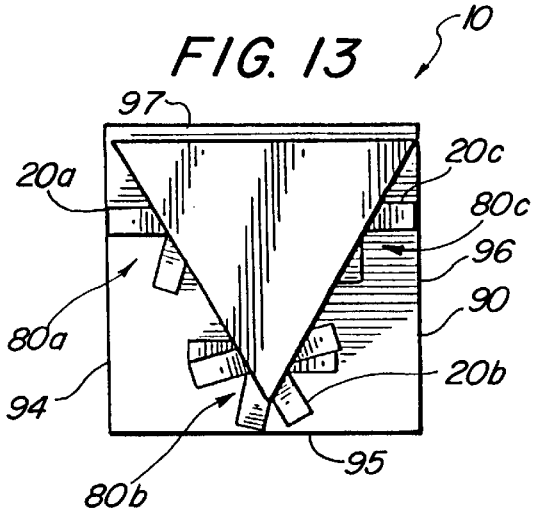
FIG. 13 is a top view of the display apparatus.

In a preferred embodiment shown in FIGS. 12 and 13, the display apparatus 10 comprises multiple stacks 80*a*, 80*b*, 80*c* of independently rotatable components 20*a*, 20*b*, 20*c*. It is to be expressly understood that more or less stacks may be provided. Each pole 60 is coupled to a base 90 and a cap 92. The cap 92 may comprise a different polygonal shape than that of the base 90. As shown in FIG. 13, the stacks 80*a*, 80*b*, 80*c* are spaced apart from each other so as to provide enough room for the rotating components 20*a* of one stack 80*a*, for example, to rotate freely without contacting the components 20*b*, 20*c* of another stack 80*b*, 80*c*. At the same time, the stacks 80*a*, 80*b*, 80*c* are preferably grouped closely together so as to minimize the area occupied. Thus, the spacing, or arrangement, of the stacks 80*a*, 80*b*, 80*c* is determined at least in part by the width of the rotating components 20*a*, 20*b*, 20*c*. In FIG. 13, all the stacks 80*a*, 80*b*, 80*c* fit nicely within the perimeter of the base 90.

In FIG. 12, it will be appreciated that the kiosk 10 enables multiple shoppers to view products on different levels of the same stack 80*a* or pole 60. Shoppers viewing products on different display components 20*a* of the same pole 60, for example, may rotate their respective components 20*a* freely without disturbing any of the other components 20*a* of that stack 80*a*. In FIG. 13, it will further be appreciated that the kiosk 10 enables viewers to access products on different sides 94, 95, 96, 97 of the kiosk 10. Thus, shoppers may access different rotating components disposed at the same horizontal level. For example, different shoppers may access the top component 20*a*, 20*b*, 20*c* of each stack 80*a*, 80*b*, 80*c* without disturbing each other. This cannot be accomplished with conventional single pole kiosks wherein rotation of a wheel on the pole causes all the elements of that wheel to rotate, thereby preventing a second viewer from viewing products on the same horizontal level.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. The claims are thus to be understood to include what is specifically illustrated and described above, what is conceptionally equivalent, what can be obviously substituted and also what incorporates the essential idea of the invention.

What is claimed is:

1. A display apparatus comprising:

a pole; and a plurality of independently rotatable components stacked on the pole;

wherein:

each component comprises at least one slat board, the slat board having a substantially vertical display surface and a projection extending from the display surface; and each component further comprises a supporting body, the slat board being removably coupled to the supporting body.

2. The apparatus of claim 1, wherein:

the slat board comprises a clip; and the supporting body comprises an aperture for receiving the clip.

3. The apparatus of claim 2, wherein the supporting body comprises a rectangular box.

4. The apparatus of claim 1, further comprising a base.

5. The apparatus of claim 1, further comprising a cap.

6. The apparatus of claim 1, wherein each component is rotatably coupled to the pole with an upper bushing and a lower bushing.

7. The apparatus of claim 1, wherein the pole comprises a first pole and the plurality of independently rotatable components comprises a first plurality of independently rotatable components, the apparatus further comprising:

a second pole; and a second plurality of independently rotatable components stacked on the second pole.

8. An apparatus for displaying wares, the apparatus comprising:

a supporting body comprising a first supporting surface, a first aperture defined in the first supporting surface, a second supporting surface spaced apart from the first supporting surface, a second aperture defined in the second supporting surface, a top opening, and a bottom opening; and a slat board comprising a front surface, a substantially parallel back surface opposite to the front surface, a protrusion extending from the front surface for supporting the wares, and a clip coupled to the back surface, wherein the slat board is removably coupled to the supporting body with the clip being received in the first or second aperture of the supporting body.

9. The apparatus of claim 8, wherein the supporting body comprises a hollow cavity.

10. The apparatus of claim 9, further comprising a pole disposed through the supporting body.

11. The apparatus of claim 8, wherein the slat board comprises a first slat board and the clip comprises a first clip received in the first aperture of the supporting body, the apparatus further comprising a second slat board with a second clip received in the second aperture of the supporting body.

12. The apparatus of claim 8, further comprising an extension removably coupled to a bottom of the supporting body.

13. The apparatus of claim 8, wherein the supporting body further comprises opaque side surfaces.

14. The apparatus of claim 8, wherein the back surface of the slat board is disposed against the first supporting surface or the second supporting surface of the supporting body.

15. A method for assembling a display apparatus, the method comprising:

disposing a first independently rotatable supporting body on a pole;

disposing a second independently rotatable supporting body on the pole;

removably coupling a first slat board to the first supporting body; and removably coupling a second slat board to the second supporting body.

16. The method of claim 15, wherein removably coupling a first slat board to the first supporting body comprises inserting a clip of the first slat board into an aperture of the first supporting body.

17. The method of claim 15, further comprising coupling each supporting body to the pole with bushings.

18. The method of claim 15, further comprising:

providing a second pole; and disposing a third independently rotatable supporting body and a fourth independently rotatable supporting body on the second pole.

19. A method of manufacturing a display apparatus, the method comprising:

providing a pole;

disposing on the pole, a first independently rotatable supporting body having a supporting surface;

forming an aperture in the supporting surface;

providing a slat board with a front surface and a back surface;

providing a configuration of protrusions extending from the front surface of the slat board;

coupling a clip to the back surface of the slat board configuring the clip of the slat board to be removably inserted into the aperture of the supporting body; and disposing on the pole, a second independently rotatable support body.

20. The method of claim 19, wherein the slat board comprises a first slat board, the configuration of protrusions comprises a first configuration of protrusions, and the clip comprises a first clip, the method further comprising:

providing a second slat board with a second clip;

configuring the second clip of the second slat board to be removably inserted into the aperture of the supporting body; and providing a second configuration of protrusions extending from a front surface of the second slat board that is different from the first configuration of protrusions.

21. The method of claim 19, wherein forming an aperture in the supporting surface comprises forming a first aperture in a first supporting surface of the supporting body, the method further comprising:

forming the supporting body with a second supporting surface; and forming an aperture in the second supporting surface.

22. The method of claim 21, wherein providing a slat board with a front surface and a back surface comprises providing a first slat board with a first clip, the method further comprising providing a second slat board with a second clip configured to be removably inserted into the second aperture of the supporting body.

23. A method for displaying goods, the method comprising:

providing a plurality of independently rotatable bodies stacked on a pole;

removably coupling a first slat board to a first side of each body and a second slat board to an opposite second side of each body; and hanging goods on protrusions extending from each slat board.

24. The method of claim 23, further comprising:

removing one of the slat boards from its corresponding body, the removed slat board having a first configuration of protrusions; and removably coupling a different slat board to the corresponding body, the different slat board having a second configuration of protrusions different from the first configuration of protrusions.

* * * * *